United States Patent [19]

Spero et al.

[11] Patent Number: 4,629,194

[45] Date of Patent: Dec. 16, 1986

[54] BOARD GAME APPARATUS

[76] Inventors: Louis A. Spero; Anna L. Markisz-Spero, both of R.D. 1, Box 341, Lily Lake Rd., Highland, N.Y. 12528

[21] Appl. No.: 731,370

[22] Filed: May 7, 1985

[51] Int. Cl.[4] ..... A63F 3/00

[52] U.S. Cl. ..... 273/236

[58] Field of Search ..... 273/236, 260, 261, 262; D21/34

[56] References Cited

U.S. PATENT DOCUMENTS

| | | | |
|---|---|---|---|
| 711,959 | 10/1902 | Graham . | |
| 2,752,158 | 6/1954 | Brunot et al. | 273/135 |
| 3,124,357 | 3/1964 | Preston | 273/130 |
| 3,460,835 | 8/1969 | Crans | 273/236 |

*Primary Examiner*—Richard C. Pinkham
*Assistant Examiner*—Stuart W. Rose
*Attorney, Agent, or Firm*—John Maier, III

[57] ABSTRACT

A game apparatus in the form of a board game and method of playing same with sixty-four subsquares comprising a main square with a border around all four sides of the main square, two sides of the border at ninety degrees to one another having one designation and the other two sides at ninety degrees to each other having a different designation with eight circles being located outside the border on all four sides of the main square. Charge discs are placed in the circles and number discs are placed in the squares, the stated value of a number disc being increased, decreased or unchanged by its respective pair of charge discs.

8 Claims, 15 Drawing Figures

BOARD GAME APPARATUS

BACKGROUND OF THE INVENTION

As is well known there are various board games which use a square with subsquares. This invention provides a unique mechanism for manipulating number values on a game board and is played by two opposing players and requiring thought and skill and rewarding the use of tactics and strategy while being amusing.

In accordance with this invention, such a board game is provided.

SUMMARY OF THE INVENTION

In accordance with this invention, a board is provided having a main square of eight sub-squares along each edge providing a total of sixty-four sub-squares. A border is provided around the outside of the main square with two sides each ninety degrees to each other having a first designation and the other two sides of the border having a second designation with eight circles located on the outside of each border along all four sides of the main square in line with each of the adjacent squares on each side.

DETAILED DESCRIPTION OF THE DRAWING

DETAILED DESCRIPTION OF THE INVENTION

Figure 1:
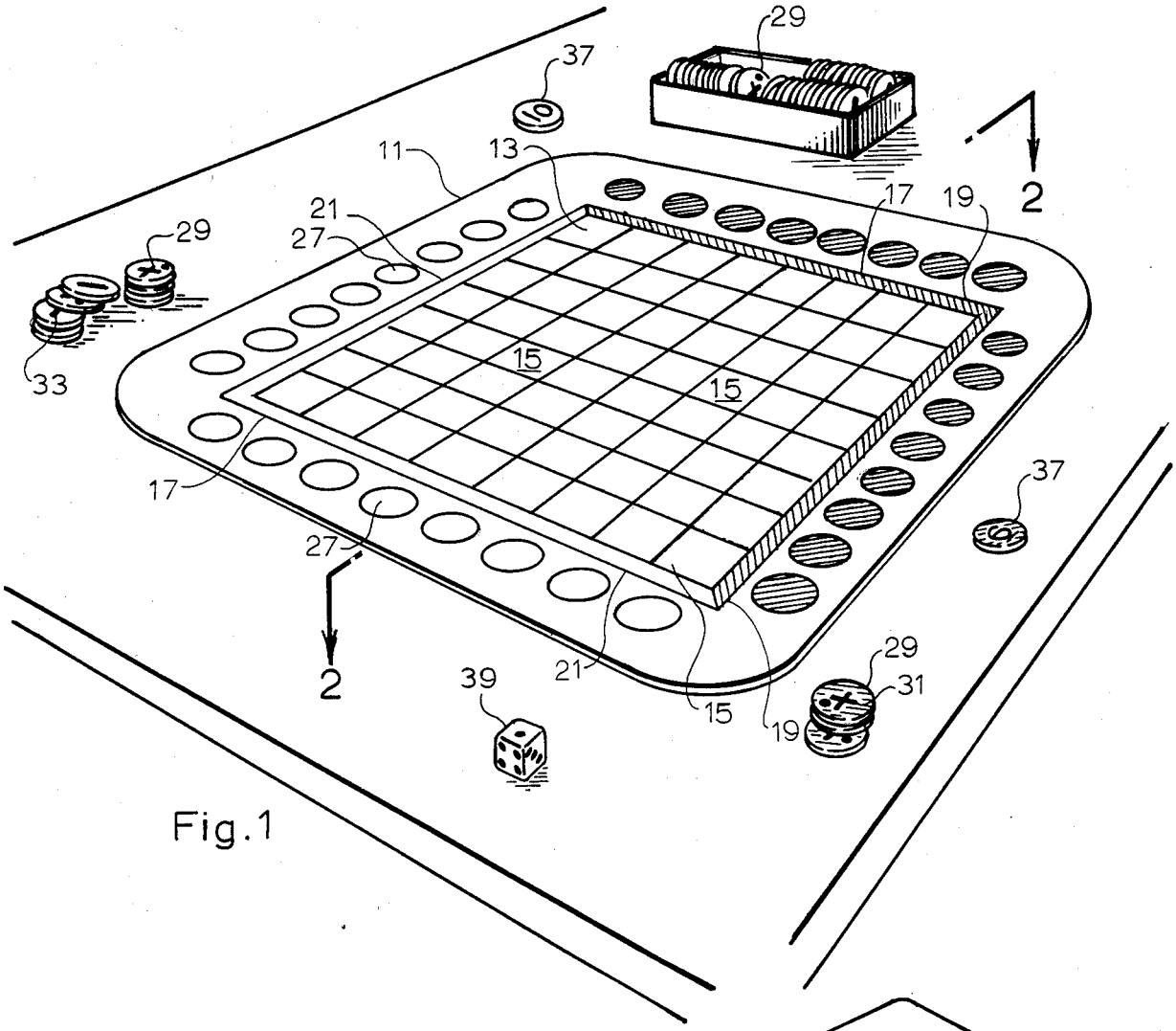
FIG. 1 is a pictorial view of the game board with the charge change die and both charge discs and number discs on the board.

The board 11, best seen in FIG. 1, includes a main square 13 broken into sixty-four subsquares 15, each side of the main square 13 having eight subsquares 15. A border 17 surrounds the main square 13. Two sides 19 of the border 17 which are substantially at ninety degrees to each other are designated in one manner such as by color or shading and the other two sides 21 are designated differently such as by some other color or shading. The two adjacent borders 21 of the main square 13 which are shown as unshaded are indicated as the first player's side and the other two borders 19 which are shaded are indicated as the second player's side.

Figure 3:
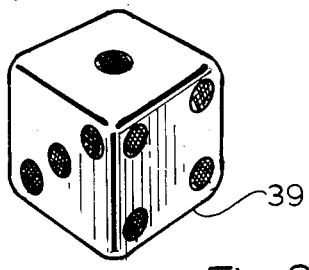
FIG. 3 is a pictorial view of a charge change die.
Figure 2:
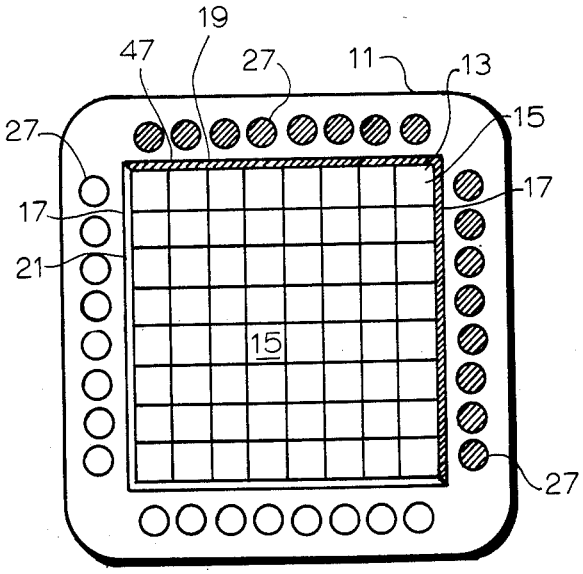
FIG. 2 shows a plan view along line 2—2 of FIG. 1 of the game board without any discs of any type on the board.
Figure 4:
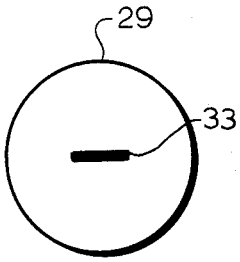
FIG. 4 is a plan view of a charge disc showing the side which faces upwardly.
Figure 5:
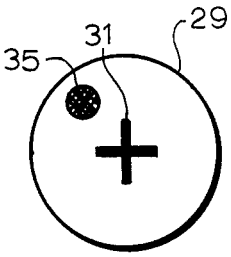
FIG. 5 is a plan view of the opposite side of the charge disc shown in FIG. 4 and showing the dot to indicate that the plus sign must face downwardly.

In line with each row of subsquares 15, along each of the four sides of the border 17 are eight circles 27. In this way, both the first player and the second player have a total of sixteen circles 27, eight along each of the two sides of the border 19, 21 designated as that players half of the border 17. Each of the two players has sixteen charge discs 29 with a plus 31 on one side and a minus 33 on the other side. Of the sixteen charge discs 29 that each player is assigned, eight have a dot 35 or other mark such as a circle on the side of the charge disc 29 with the minus 33 and eight have a dot 35 on the side of the charge disc 29 with the plus 31. Preferably, the charge discs 29 are designated or color coded in the same way that the board 11 and border 17 is coded. In addition to the charge discs 29, each player receives thirty-two (32) number discs 37, again designated or coded to distinguish between the two players. For each player there are three groups of number discs 37 with the number one (1) through nine (9) and five more numbered discs each numbered ten (10). One side of each number disc 37 is blank. Holders (not shown) may also be used for convenience to hold the number discs 37. A die or cube 39 best seen in FIG. 3, which is called a charge change die 39 is used, as will subsequently be explained, to determine whether a player who has lost points can change a charge disc 29 in the same manner as would have been possible had he or she achieved a specified level of points without first having lost points.

Each of the two players, the first player and second player, collect their number discs 37 with the numbers face down so that the numbers cannot be seen. The number discs 37 of each player are mixed and shuffled so that the identity cannot be known to the player. Each player then selects one number disc 37. The player with the highest number plays first. In the event of a tie, the selection of one number disc 37 by each player after shuffling is redone until one of the two players achieves a higher number. The number discs 37 which are utilized for selecting which player goes first are then placed face down back with that players number discs 37 and the numbers are again mixed and shuffled.

The player who was selected to be first to play then places a charge disc 29 on one of the sixteen circles 27 assigned to that player and then the other player places a charge disc 29 on the board 11, always with the dot 35 face down. The players alternate placing charge discs 29 with the dot 35 down until both have filled the sixteen circles 27 available. In this way, of the sixteen charge discs 29 assigned to each player, each player will have eight charge discs 29 with a negative or minus charge 33 and eight charge discs 29 with a plus charge 31.

Each of the players then selects at random, seven (7) number discs 37 from their respective collection of number discs 37 with the numbers face down and then places them face up. The seven (7) selected number discs may be placed in a holder (not shown), if available. The player who was previously selected first to proceed first then places a number disc 37, face up, on any of the sixty-four subsquares 15 of the main square 13 of the game board 11. It is here that a great deal of the skill is required because very careful consideration must be given to the strategic advantage to the subsquare 15 on which the number disc 37 is placed. The opponents then alternate with one another to place one number disc 37 at a time until both players have placed all of their number discs 37. Once a number disc 37 is placed on a particular subsquare 15 it remains on that subsquare 15 throughout the game but may be turned over depending upon certain factors which will hereinafter be explained. A player may balance a number disc 37 on edge but once the number disc 37 is laying down flat and the player's hand is removed, the move is complete and cannot be changed. Once a player uses a number disc 37, another number disc 37 is selected at random from that player's group of number discs 37 which remain face down. This replacement disc is then added to the remaining six number discs so that each player always has a reserve of seven discs until his or her disc supply is less than seven.

Figure 8:
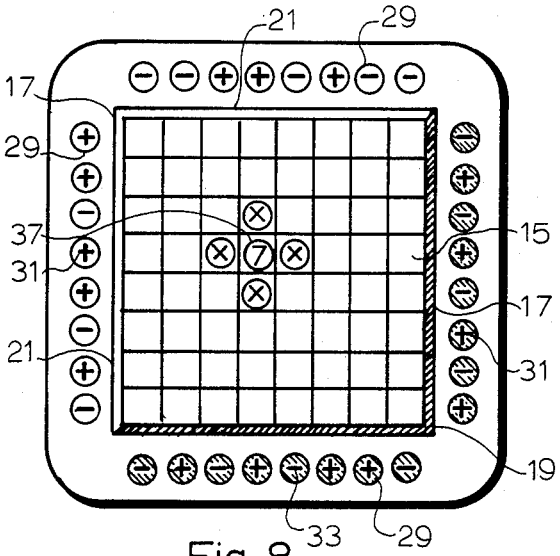
FIG. 8 shows the same board as FIG. 2 with the number seven on the board while further showing those adjoining positions marked with an X which would be the subsquares which may be used to attack or be attacked by the number seven disc or any other disc in that same subsquare where the number seven disc is shown.

The ultimate goal of the game is to have the highest score which is the sum of the face values of number discs 37 of each player remaining face up on the board 11. Therefore, it is essential to attack the other player by eliminating his number discs 37. A player may place his number disc 37 on any available subsquare 15. However, in order to attack the other players number discs 37, a player places his or her number disc 37 on any empty subsquare 15 which shares one of the four sides of a subsquare 15 occupied by one of the opponent's number discs 37. This is shown in FIG. 8 in which the number disc 37 with the number seven belonging to one player is located in a subsquare 15 showing circles with an X in those subsquares 15 where the opposing player can place his number disc 37 to challenge the number disc 37 already on the board 11. The number disc 37 with the highest modified value wins the conflict. "Modified value" means the face value either unchanged or as altered either higher or lower by the charge discs aligned with it.

Figure 6:
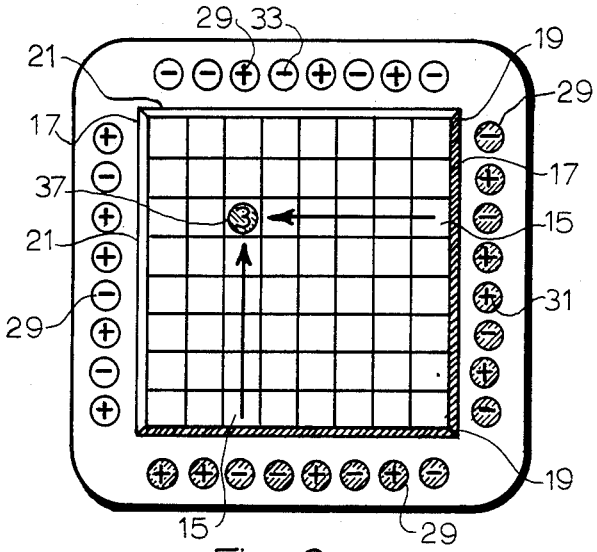
FIG. 6 shows the same board shown in FIG. 2 with charge discs located along the peripheral circles in accordance with the selection of the two opposing players and with the number disc three on the board with arrows to indicate the charge discs which act upon the number disc.
Figure 7:
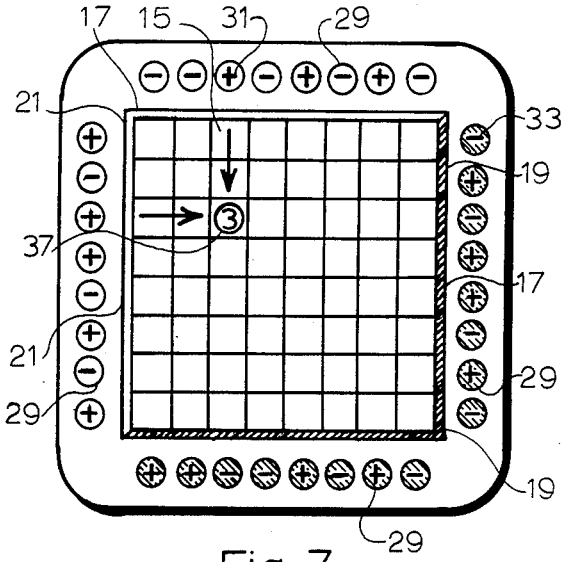
FIG. 7 is the same as FIG. 6 except that it shows the same number being modified in value by the other player's charge discs is indicated by the arrows.

In determining the modified value of a number disc 37, the number on the face of the number disc 37 is only a portion of the determination. A modification of that number is derived from the charge discs 29 of the same player and not the charge discs 29 of the other player. As best seen in FIG. 7, if the charge discs 29 of the same player are both plus, the value of the number disc 37 is doubled. Referring again to FIG. 7, arrows are shown on the board 11 directed at the number disc 37 bearing the number three (3) to show that only the charge discs 29 on two sides 19 of the border 17 are used. If the two charge discs 29 of the same player are both minus, as best seen in FIG. 6, the number on the number disc 37 is halved. Again, with reference to FIG. 6, arrows are used to show which charge discs 29 apply. The value of the number disc 37 remains unchanged if one charge disc 29 is plus and the other is minus.

Figure 9:
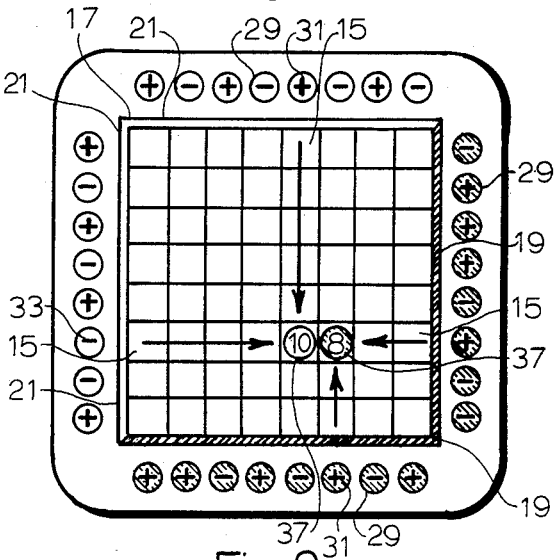
FIG. 9 shows the same board as in FIG. 2 with a number ten disc on the board for one player and a number eight disc adjacent it for the other player with arrows to indicate which charge discs relate to which number disc.

In FIG. 9, one player has placed a number disc 37 with the number ten (10), but modified by a charge disc 29 with a plus and a charge disc 29 with a minus of that same player with arrows to show which charge discs 29 apply. The second player has placed a number disc 37 having the number eight (8) next to the number ten (10) but which is intersected by that player's two charge discs 29 which are both a plus 31. The value of the number disc 37 with the number eight (8) therefore becomes sixteen (16). The number disc 37 with the number ten (10) is turned over and becomes of no value.

Figure 10:
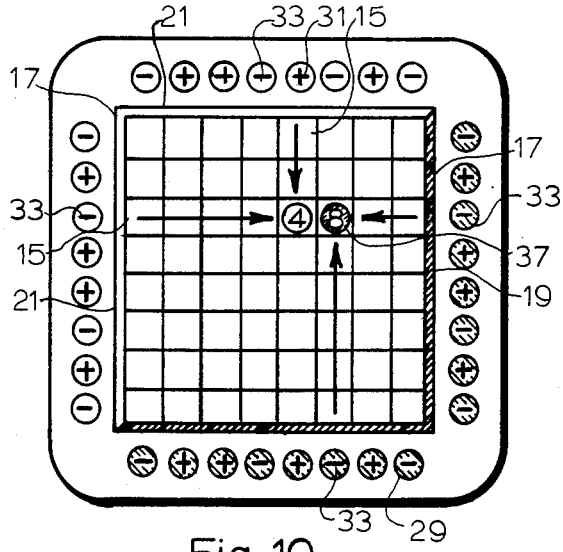
FIG. 10 shows the same board game as shown in FIG. 2 with a four on the board for one player adjacent an eight for the other player with arrows to indicate which charge discs relates to which number disc.

When two number discs 37 oppose one another and the value of both of them, as modified by their respective charge discs 29, is the same, the result is that both number discs 37 are neutralized with the physical result that both number discs 37 are then turned over. This can be seen in FIG. 10 where a number disc 37 with the number eight (8) is located on the board 11 so that it is modified by two charge discs 29 which are both minus 33 having thus a value of 4. The other player's number disc 37 has a face value of four (4) which is modified by charge discs 29, one of which is a plus 31 and the other is a minus 33. Arrows show which charge discs 29 pertain to which number disc 37. Therefore, the value of the number four (4) is unmodified and both number discs have the same value of four (4) and as a result both are turned over and are of no further significance and having no value.

Figure 11:
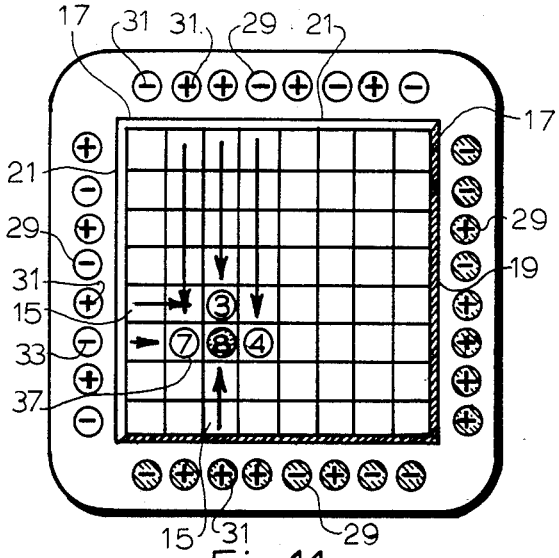
FIG. 11 shows the same board as shown in FIG. 2 with an eight for one player located amidst a seven, a three and a four for the other player with arrows to indicate which charge discs relate to which number disc.

One of the factors is dealing with a cluster situation which can be seen in FIG. 11. The first player has placed a number disc 37 with the number seven (7), a number disc 37 with the number three (3), and a number disc 37 with the number four (4) on the board 11 and the second player has placed a number disc 37 with the number eight (8) in a position so as to be able to oppose all three number discs 37 of the first player. The number disc 37 with the number eight (8) is modified by the charge discs 29 belonging to the second player which results in both charge discs 29 being a plus 31 so the actual value of the number disc 37 with the number eight (8) is sixteen (16). In the same manner, using the first player's charge numbers 29, the number four (4) is cut in half to a value of two (2), the number three (3) is doubled to a value of six (6), and the number seven (7) remains unchanged with a value of seven (7). Thus, the highest modified value of all number discs 37 is that of the number disc 37 with the number eight (8). In this situation all of the three opposing numbers are all neutralized and thus are turned over, having no value.

Figure 12:
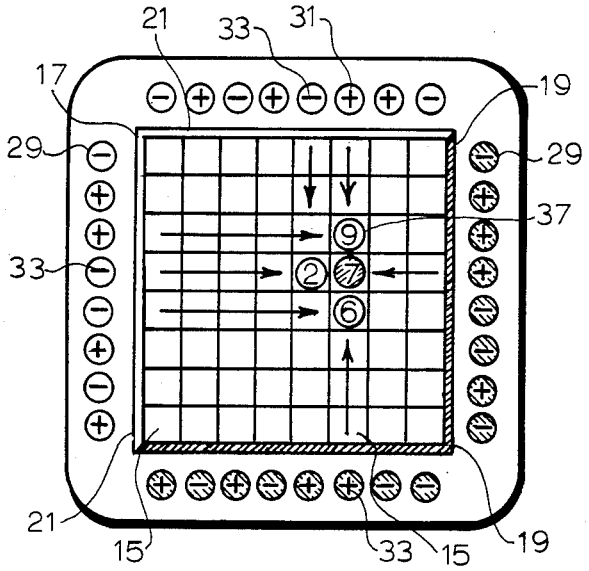
FIG. 12 is the same board as shown in FIG. 2 but shows a nine, a two and a six on the board for the first player surrounding a seven for the second player.
Figure 13:
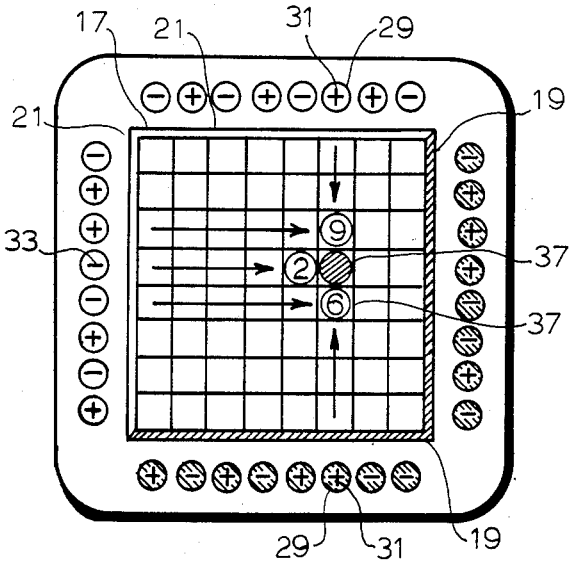
FIG. 13 is the same view as FIG. 12 except that the number disc with the number 7 is turned over having been neutralized.

Still another cluster situation is shown in FIG. 12 where the first player has a number disc 37 with the number nine (9), a number disc 37 with the number two (2), and a number disc 37 with the number six (6). The number disc 37 with the number seven (7) belongs to the second player which uses the charge disc 29 along the shaded border 19. All the other number discs 37 are modified by the charge discs 29 along the unshaded border 21. As a result the number disc 37 with the number nine (9) has a modified double value of eighteen (18), the number disc 37 with the number two (2) has a modified value of only one (1) and the number disc 37 with the number six (6) has a value of only six (6). The number disc 37 with the number seven (7), however, has a modified value of fourteen (14) which is greater than the modified value of the number disc 37 with number two (2) and the number six (6) but less than the modified value of the number disc 37 with the number nine (9). Since the number disc 37 with the number nine (9) wins, as seen in FIG. 13, it neutralizes the number disc 37 with the number seven (7) which is turned over and all three number discs 37 of the first player remain unchanged and in full force with their numbers up on the board.

Figure 14:
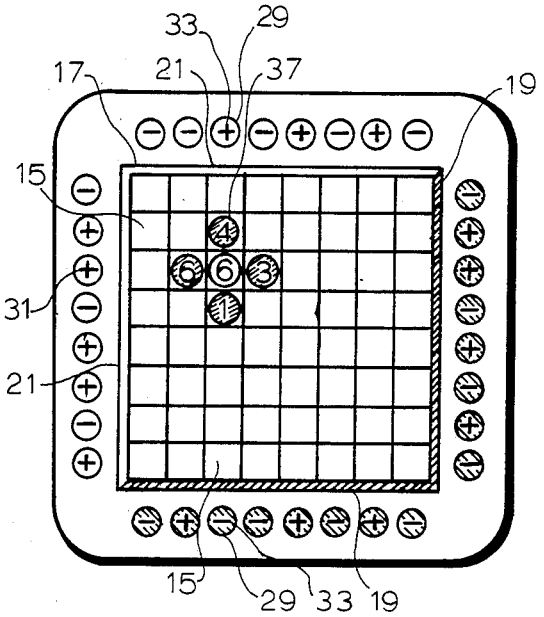
FIG. 14 is the same board as shown in FIG. 2 but shows a six for the second player surrounded by a three, four, six and one for the first player.
Figure 15:
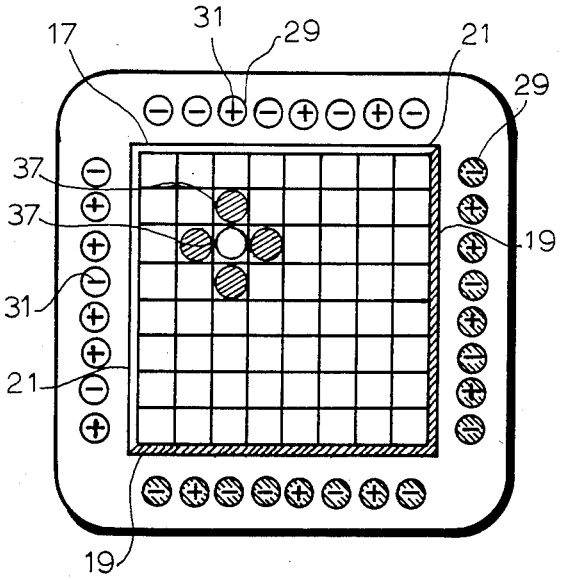
FIG. 15 is the same view as FIG. 14 except that only the number 6 of the second player remains up while the other number discs, all belonging to the first player, have been turned over having been neutralized.

In FIG. 14, the first player, with the unshaded border 21 has placed a number disc 37, with the number six (6) in the middle among number discs 37 belonging to the second player, with the shaded border 19 with the number discs 37 having the numbers of six (6), four (4), three (3) and one (1). The first players number disc six (6) has, since it is modified by two charge discs 29, which are both plus 31, a modified value of twelve (12). The second player's number disc 37 with the number six (6) is also modified by charge discs 29, both of which are also plus 31, so that number disc 37 with the number six (6) also has a modified value of twelve (12). The remaining number discs 37 of the second player all have a modified value less than twelve (12) and are thus clearly neutralized. As best seen in FIG. 15, since the remaining number discs 37 are of equal value, the four number discs 37 of the second player and the one number disc 37 of the first player are all neutralized and turned over.

When both players have placed all of their number discs 37, the game is over. The player with the highest total of face values on his or her number disc 37 remaining face up, is the winner. In computing the final score, modified values are not used.

An added feature of the game is that each player is given an opportuntiy to change one of his or her charge discs 29 for every 25 points of actual face value of his or her number discs 37 on the board 11. If, however, a player has points so as to change a charge disc 29 and then loses those points but later regain those points, that player can then roll the charge change die or cube 39 and if either the number one or the number six turns up, the player may again change a charge disc 29.

While a preferred embodiment has been shown and described, various modifications and substitutions may be made without departing from the spirit and scope of this invention. Accordingly, it is understood that this invention has been described by way of illustration rather than limitation.

I claim:

1. A game apparatus comprising:

a substantially flat surface;

a main square playing area outlined on the flat surface, said main square being subdivided into sixty-four subsquares, eight subsquares being located along the edge of each of the four sides of the main square;

a border surrounding the main square, two sides of said border at right angles to one another having a first designation and the other two sides of the border having another designation;

thirty-two spaces outside said border, each of said spaces being aligned with a row of subsquares, eight spaces being located along each side of said border; and two sets of sixteen charge discs, each set of charge discs having a separate designation and each charge disc of each set having a plus sign on one side and a minus sign on the other side and each set of sixteen charge discs having a mark on the plus side of eight of the charge discs and a mark on the minus side of eight of the charge discs.

2. A game apparatus according to claim 1 wherein said spaces are circles, each of the circles being designated in the same manner as the border adjoining that circle.

3. A game apparatus according to claim 1 further including two sets of number discs, each set having a separate designation, each set including three groups consisting of the numbers one through nine and five number discs with the number ten, one side of each number disc being blank.

4. A game apparatus according to claim 1 wherein said spaces are circles, each of the circles being designated in the same manner as the border adjoining that circle and further including two sets of number discs, each set having a separate designation, each set including three groups consisting of the numbers one through nine and five number discs with the number ten, one side of each number disc being blank.

5. A game apparatus comprising:

a substantially flat surface;

a main playing area outlined on the flat surface, said main playing area being subdivided into a plurality of subareas forming rows of subareas;

a border surrounding the main playing area, substantially half of said border having a first designation and the other half of the border having another designation;

a plurality of spaces outside said border, each of said spaces being aligned with the subareas; and two sets of charge discs, each set of charge discs having a separate designation and each charge disc of each set having a plus sign on one side and a minus sign on the other side and each set of charge discs having a mark on the plus side of one-half of the charge discs and a mark on the minus side of the other one-half of the charge discs.

6. A game apparatus according to claim 5 wherein said spaces are circles, each of the circles being designated in the same manner as the border adjoining that circle.

7. A game apparatus according to claim 5 further including two sets of number discs, each set having a separate designation, each set including a plurality of groups including the numbers one through ten, one side of each number disc being blank.

8. A game apparatus according to claim 5 wherein said spaces are circles, each of the circles being designated in the same manner as the border adjoining that circle and further including two sets of number discs, each set having a separate designation, each set including a plurality of groups including the numbers one through ten, one side of each number disc being blank.

* * * * *